United States Patent [19]

deBeus

[11] Patent Number: 4,676,740

[45] Date of Patent: Jun. 30, 1987

[54] HEAT EXCHANGE APPARATUS AND PROCESS FOR ROTARY KILNS

[76] Inventor: Anthony J. deBeus, 2001 Highland Dr., Newport Beach, Calif. 92660

[21] Appl. No.: 843,155

[22] Filed: Mar. 24, 1986

[51] Int. Cl.[4] ..... F27B 7/10; F27B 14/00

[52] U.S. Cl. ..... 432/103; 432/113; 432/114; 432/118; 432/119

[58] Field of Search ..... 432/103, 105, 106, 108, 432/110, 111, 117, 118, 119

[56] References Cited

U.S. PATENT DOCUMENTS

| | | | |
|---|---|---|---|
| 609,920 | 8/1898 | Stowe . | |
| 1,544,504 | 6/1925 | Tomlinson . | |
| 1,826,847 | 10/1931 | Vanderwerp . | |
| 1,841,625 | 1/1932 | Musso | 432/113 |
| 1,995,948 | 3/1935 | Shafter et al. | 222/7 |
| 2,084,713 | 6/1937 | Thayer | 263/22 |
| 2,869,849 | 1/1959 | Folloit et al. | 432/118 |
| 2,889,143 | 6/1949 | Reaney et al. | 432/118 |
| 3,039,753 | 6/1962 | Eketorp et al. | 432/117 |
| 3,057,612 | 10/1962 | Struckmann | 432/119 |
| 3,169,016 | 2/1965 | Wicken et al. | 432/119 |
| 3,175,815 | 3/1965 | Wicken et al. | 432/118 |
| 3,294,384 | 12/1966 | Hollefriend | 432/110 |
| 3,872,918 | 3/1975 | Stalker | 165/5 |
| 4,290,750 | 9/1981 | Whiteley | 432/118 |
| 4,391,206 | 7/1983 | Matteini | 110/246 |
| 4,492,043 | 1/1985 | Zannoni | 432/114 |
| 4,522,587 | 6/1985 | Miller | 432/114 |

FOREIGN PATENT DOCUMENTS 652290 4/1928 France .

*Primary Examiner*—Henry C. Yuen

*Attorney, Agent, or Firm*—Walter A. Hackler

[57] ABSTRACT

Heat exchange apparatus is provided for use in a rotary kiln having a bed therein for introducing thermal energy directly into central portions of the bed without lifting or tumbling thereof. In this manner, efficient heat transfer is effected from hot upper portions of the kiln to within central portions of the bed without causing significant dust generation which results in unwanted loss of heat and raw materials from the kiln. A plurality of tubular refractory members are held in a spaced apart relationship with the rotary kiln wall which are heated in the upper portions of the kiln and cooled as they pass through the bed when the kiln is rotated.

5 Claims, 6 Drawing Figures

HEAT EXCHANGE APPARATUS AND PROCESS FOR ROTARY KILNS

The present invention relates generally to rotary kilns and, more specifically, to heat exchange apparatus and a process for introducing thermal energy directly into central portions of a bed disposed in a lower portion of a rotary kiln.

The thermal energy transferred into the central portions of the bed is taken from upper heated portions of the rotary kiln above the bed and heat transfer occurs as the rotary kiln is rotated.

A rotary kiln is an important processing furnace and is probably used in more different industries than any other type of kiln. For example, rotary kilns are used in the manufacture of cement, lime, magnesium oxides, aluminum, beneficiation of iron oxides, and in various other processes involving sintering, beneficiation and calcining of raw materials.

Generally, a rotary kiln may be a steel vessel with typical diameters from between about 6 feet to 25 feet and lengths from 100 feet to 700 feet.

In operation, the kiln is rotated slowly, usually between 1 RPM and 5 RPM, by means of a motor and drive gear. Raw material is introduced into a feed end of the rotary kiln which forms a bed and moves along the kiln as it is rotated toward a discharge end of the kiln. A burner is provided at the discharge end to heat the kiln and the bed in the lower portion of the rotary kiln.

The combustion gas from the burner disposed at the discharge end of the kiln flows in a counterdirection to the movement of the raw materials within the rotary kiln. Movement of the materials is promoted by inclining the rotary kiln so that the feed end is higher than the discharge end thereof.

Many types of raw materials may be utilized in a kiln and the process may be that of drying or a chemical reaction. If the raw material feed is a mud, the process is called a "wet process". On the other hand, if the raw material is dry solids, the process is called a "dry process".

Typically, the bed passing through the rotary kiln undergoes four separate processes during its passage through the kiln. In order, these processes are: drying, preheating, calcining and sintering.

As the raw materials move through the kiln, they slowly rise in temperature while the combustion gases, flowing in a counterdirection thereover, slowly decrease in temperature as they release heat to the raw materials and the firebrick lining in the kiln.

It is well known that rotary kilns are inefficient heat exchangers, because the bed therein only occupies about 10 percent of the internal volume of the kiln. The bed, or load, slides on the bottom of the kiln and the hot combustion gases only contact the surface of the bed.

Interior portions of the bed are not directly heated by the combustion gases, hence, attempts have been made to expose the central portions of the bed to the heat. These devices have included chains and lifters, or the like, for splitting or tumbling the bed to expose the core, or central portions of the bed, to the heat of the overhead gases and the hot brick lining.

Unfortunately, this tumbling in many situations produces dust which is swept out of the kiln by the combustion gases.

The represents a loss of process materials and can significantly reduce the efficiency of the kiln, because not only is raw material lost, but a significant amount of heat is taken by the hot dust exhausted by the kiln.

The lifters, or tumblers, of the prior art are relatively ineffective because only the hot outside surface thereof comes into contact with the raw materials.

It is also well known that when beds of solid particles which have not been closely screened are rotated within a kiln size segregation of the particles occur. In this segregation the finest sizes remain at the bottom in contact with the hot firebrick and the coarser particles form an upper layer of the bed.

It is apparent that as the kiln rotates, the exposed firebrick, in an upper position, of the kiln absorbs radiant heat from the combustion gases and, as the heated firebrick completes its rotation, it passes under and inconductive contact with the fine particles. Hence, the fine particles are heated by the direct solid-to-solid transfer and the large particles are heated by direct radiation from the gas and brick.

However, the intermediate size particles remain, throughout a complete kiln revolution, sandwiched between the coarse and fine layers, and are protected from the heat by the insulating properties of these layers. In the case of rotary kilns used for cement production, this may result in portions of the raw materials escaping complete calcination.

Hence, there is a need for heat exchange apparatus and process for transferring or introducing heat, or thermal energy, directly into central portions of a bed disposed in a rotary kiln without causing significant tumbling or agitation of the bed which produces undesirable dust formation.

SUMMARY OF THE INVENTION

Heat exchange apparatus in accordance with the present invention for use in a rotary kiln having a bed therein includes heat exchange means for introducing thermal energy directly into central portions of the bed, or load, which is disposed in a lower portion of the rotary kiln.

In this manner, heat transfer is effected to central portions of the bed which otherwise are not directly heated because of overlying and underlying bed layers. As hereinbefore pointed out, the lower layers of the bed are in contact with the hot fire-brick and are heated by conduction. Upper, or surface layers of the bed, are heated by radiation from both the overhead combustion gases and the firebrick at the top of the furnace.

Hence, in accordance with the present invention, direct heating of the central bed areas can be accomplished.

The heat exchange means in accordance with the present invention includes refractory means for transferring heat from the upper heated portions of a rotary kiln above the bed into the bed as the rotary kiln is rotated.

Also, the present invention includes means for causing the heat exchange means to cyclically pass through the upper portion of the rotary kiln to within the bed as the rotary kiln is rotated.

More particularly, the present invention includes means for attaching the refractory means in a spaced apart relationship with an interior wall of the rotary kiln in order to cause the refractory means to pass through the bed, with a portion of the bed passing under the refractory means and a portion of the bed passing over the refractory means in order to enhance the heat transfer therebetween as the rotary kiln is rotated. The enhanced heat transfer is importantly in the central portion of the bed.

Also significant and a part of the present invention is means for attaching the refractory means and configuring the refractory means for being operative for stirring the reaction bed as the refractory means pass through the bed without significantly lifting of the bed to the upper heat portions of the rotary kiln as the rotary kiln is rotated.

This feature is important in that, because the bed is mixed as the refractory means pass through, but not disturbed, dust generation is minimized.

This is to be contrasted with prior art devices which purposely lift the reaction bed to upper regions of the rotary kiln in order to disperse the reactants in the air in order to promote a mixing of the bed with oxygen, as for example, to oxidize or burn material in the bed.

In many instances, bed reactants should be held in close proximity to each other during the course of the reaction, hence, the dispersion of the bed to the upper portions of the rotary kiln is undesirable.

Specifically, the heat exchange apparatus in accordance with the present invention, utilizes at least one cylindrical member for the refractory means which is disposed in a coaxial relationship with the rotary kiln. In fact, the refractory means may comprise a plurality of cylindrical members disposed in a spaced apart relationship with one another along the rotary kiln inner wall parallel to the axis of the rotary kiln.

Where the refractory means comprises a plurality of tubular refractory members, a plurality of rods supported in a spaced apart relationship with the rotary kiln by a plurality of stanchions may be provided onto which the tubular refractory members are disposed.

In order to accommodate thermal expansion, the tubular refractory members are disposed on the rods with compressible refractory spacers therebetween for accommodating such heat expansion.

Additionally, the tubular refractory members are disposed on the rods with compressible refractory sleeves therebetween and are sized so that the tubular refracting members are tightly held against the compressible refractory sleeves when the rotary kiln is at operating temperatures in order to inhibit fracturing of the tubular refractory members as they pass through the bed.

In order to accommodate linear expansion of the supporting rods without elaborate equipment and continued maintenance thereof, each of the stanchions includes means defining a hole therein for supporting the rod and enabling the rod to expand longitudinally within the hole.

Continuing, a process in accordance with the present invention for transferring heat from heated upper portions of a rotary kiln to within a bed, or load, disposed in lower portions of a rotary kiln includes the steps of fixing a plurality of refractory members in a spaced apart relationship with an interior wall of a rotary kiln. The plurality of refractory members are configured and operative for stirring a reaction bed disposed within the lower portion of the rotary kiln when the kiln is rotated without significant lifting of the reaction bed to heated upper portions of the rotary kiln.

In addition, the process includes disposing a bed within the lower portion of the rotary kiln, heating the upper portion of the rotary kiln and rotating the rotary kiln.

BRIEF DESCRIPTION OF THE DRAWINGS

The advantages and features of the present invention will appear from the following description when considered in conjunction with the accompanying drawings, in which.

DETAILED DESCRIPTION

Figure 1:
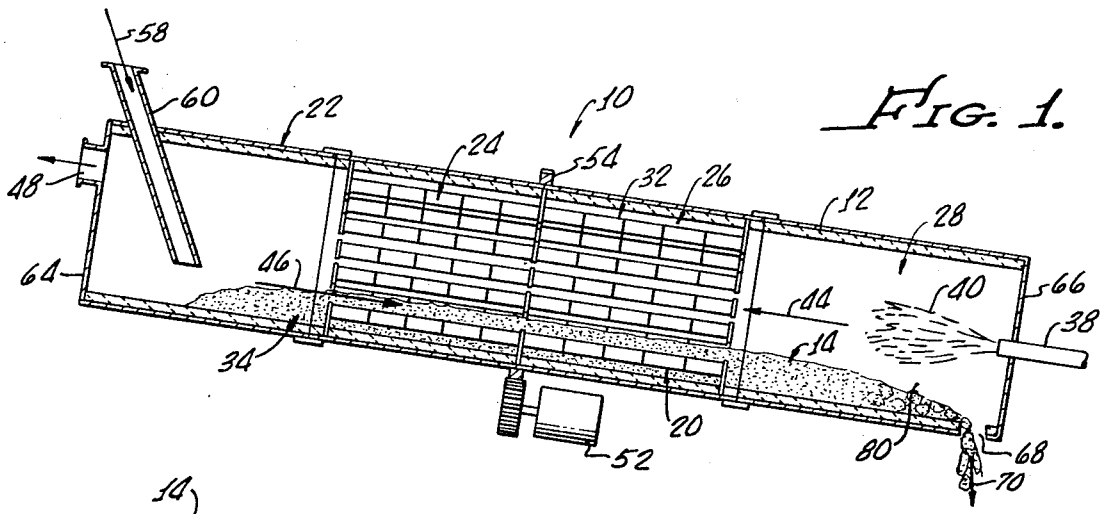
FIG. 1 is a diagrammatic cross-section of a rotary kiln generally showing heat exchange apparatus, in cross section, in accordance with the present invention, installed therein.

Turning now to FIG. 1, there is shown in schematic format a rotary kiln 10 lined with suitable firebrick 12 with a bed 14 therein in which heat exchange apparatus 20 in accordance with the present invention may be used to advantage.

Generally, the rotary kiln may be considered to have four separate zones therein: a drying zone 22, a preheat zone 24, a calcining zone 26, and a burning zone 28.

The heat exchange apparatus 20 in accordance with the present invention may be installed in either the drying, preheat or calcining zone 22, 24, 26 for transferring heat from upper heated portions 32 to the kiln 10 to central portions 34 of the bed 12, as will be hereinafter described in greater detail.

It should also be appreciated that heat exchanges are usually not installed in the burning zone 28 of the kiln 10, because of the temperatures therein may approach 3000° F.

The upper portion 32 of the kiln 10 is heated by means of a burner 38 which produces a flame 40 in the upper portion 32 of the kiln, and yielding hot exhaust gases which move in a counterdirection 44 to the movement 46 of the bed 14. The combustion gases leave the kiln 10 through an exhaust portion 48.

As represented in FIG. 1, the kiln 10 is rotated by a motor 52 coupled to a circumferential gear 54 attached to the kiln 10.

Raw material 58 is introduced within the kiln via a spout 60 to form the bed 14 therein which moves in a counterdirection to the combustion gases as a result or rotation of the kiln 10 and a slight pitch, or tilt, of the kiln from a cool end 64 thereof, to a hot end 66, thereof, the pitch usually being about $\frac{3}{8}''$ per foot of kiln 10.

As indicated by the hereinbefore-reference zones within the rotary kiln, the raw materials go through four major processes. That is, drying in zone 22, preheating in zone 24, calcining in zone 26 and burning and sintering in zone 28.

Carbon dioxide is driven off in the calcining zone 26 and the bed begins to fuse so that the end product is a sintered mass, or clinker, 70 which emerges from an exit port 68 of the kiln.

An advantage of the present invention is that it may be utilized within the calcining zone of the rotary kiln. Prior art steel heat exchangers cannot be used because of the prohibitive temperatures of up to 2400° F.

It is also apparent from FIG. 1 that disturbances of the bed, which may be finely ground particles, may cause dust to rise into the upper portions 32 of the kiln at which point they are swept by the combustion gases 44 out the exhaust port 48, resulting in a significant material loss as well as the heat carried by the dust particles. Therefore, it is not practical to tumble the bed in order to enhance heat transfer therein.

Figure 2:
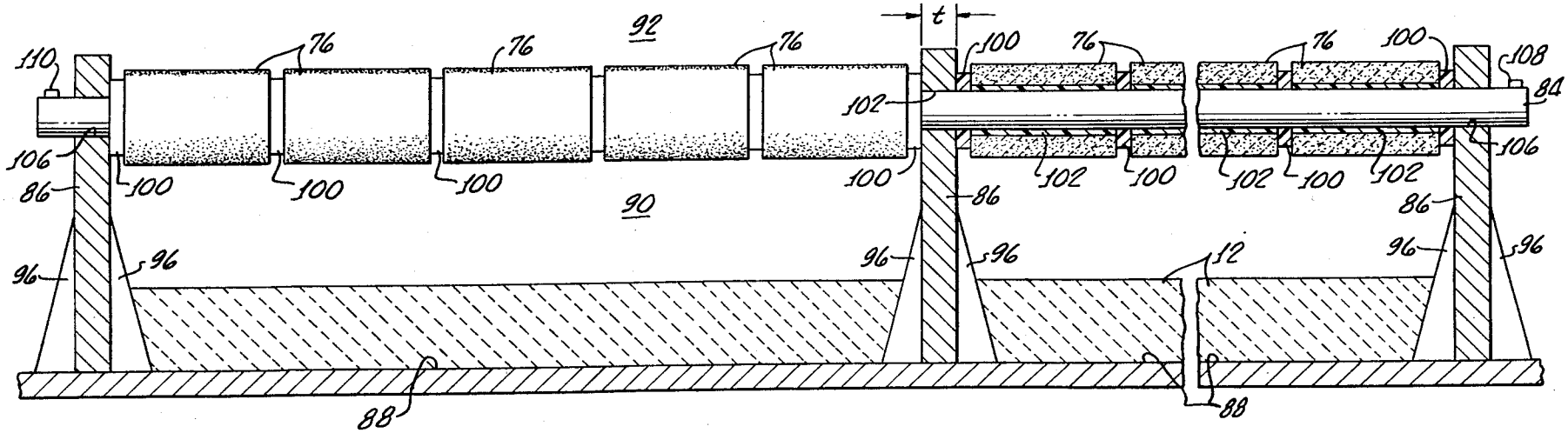
FIG. 2 is a cross-sectional view of refractory means for transferring heat from an upper portion of a rotary kiln above a bed therein to within the reaction bed which enables the refractory means to pass through the bed with a portion of the reaction bed passing under the refractory means and a portion of the bed passing over the refractory means, said refractory means consisting of a plurality of tubular ceramic members held in a spaced apart relationship by compressible refractory spacers.

Turning now to FIG. 2, there is shown more particularly heat exchange apparatus 20 in accordance with the present invention which includes a plurality of cylindrical refractory members, or tubes, 76 which may be mounted parallel to the axis (not shown) of the rotary kiln.

The refractory members may be formed from any suitable ceramic for withstanding the calcining temperatures of up to 2400° F. and are operative for transferring heat from the upper portions 32 of the rotary kiln to within the bed 20 disposed in a lower portion 80 of the rotary kiln as the rotary kiln 10 is rotated.

As the refractory members 76 pass through the combustion gases 44, they are heated thereby and thereafter transfer the heat into the central portion 34 of the bed 14 when they are submerged within.

The use of a ceramic refractory means enables the apparatus 10 to be installed in the calcining zone 26 of the kiln 10. It is also apparent that the apparatus 20 may be installed in both the drying zone 20 and the preheating zone 24 of the kiln 10 if so desired.

The ceramic members 76 are supported by a suitable high temperature alloy rod 84, which in turn is supported by a set of stanchions 86 comprised of a suitable material for withstanding the temperatures within the kiln 10. Hence, the rod 84 and stanchions 86 provide means for attaching the refractory member 76 in a spaced apart relationship within an inner wall 88 of the kiln 10.

It should be appreciated that the refractory members 76 also function to insulate the support rod 84 from the high temperatures in the upper parts 32 of the kiln 10 thus enabling the heat exchange apparatus 20 to be installed in the calcining zone, or region, of the kiln 10.

As the kiln is rotated, the rod and stanchions attached to the kiln wall 88 carry the refractory members through the upper portion 32 of the kiln and thereafter cyclically through the bed 14, with a portion of the bed 90 passing under the refractory members 76 and a portion of the reaction bed 92 passing over the refractory members in order to enhance the heat transfer therebetween.

Figure 3:
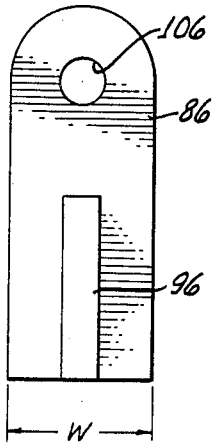
FIG. 3 is a plan view of a stanchion for supporting the tubular ceramic members on a rod in a spaced apart relationship with the rotary kiln's inner wall.

In order to reduce any lifting of the bed's upper portions 32 of the rotary kiln, which may cause excessive dust formation, the refractory members 76 and the stanchions are sized and configured to present a low profile to the rotary bed, i.e., the stanchions have a small thickness, t, with regard to their width, w, see FIGS. 2 and 3, and are arranged so that the stanchions enter the bed with the thickness, t, being transversed thereto to prevent the stanchions from acting as paddles, or the like. Further strengthening of the attachment of the stanchions to the kiln wall may be provided by a triangular members 96 attached thereto. The triangular shape minimizes the cross-section thereof that passes through the bed.

While other shapes may be utilized, the tubular shape of the refractory member 76 reduces the disturbance of the bed as it passes over and under the refractory members 76.

Figure 4:
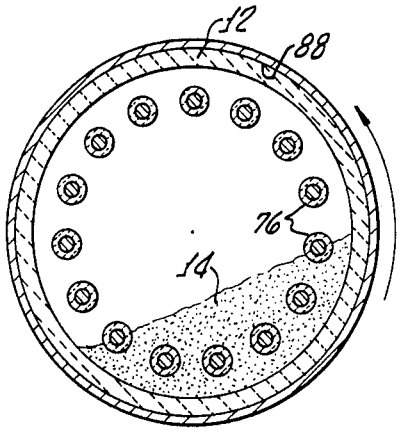
FIG. 4 is a cross-sectional view of a rotary kiln with the heat exchange apparatus in accordance with the present invention installed therein, showing the refractory members as they pass through central portions of the bed; and, FIGS. 5 and 6 are illustrations of an alternative mounting of the refractory means within the rotary kiln.

As shown in FIG. 4, the ceramic members may be disposed in a spaced apart relationship around the interior of the rotary kiln. While only one layer, or tier, of the refractory members is shown, it should be appreciated that any number of additional tiers spaced apart from the shown refractory members 76 toward the center of the kiln 10 may be provided depending upon the thickness of the bed 14 and the desired heat transfer needs.

In order to accommodate for differential thermal expansion between the ceramic cylindrical members 76 and the rod 84, a plurality of refractory spacers 100, which are compressible and may be of any suitable type well known in the art, are disposed between the refractory members 76.

Additionally, as more clearly shown in the broken away portion of FIG. 2, compressible refractory sleeves 102 are provided between the refractory members 76 and the rod 84 in order to accommodate a differing thermal expansion therebetween.

It should be appreciated that the diameter of the rod and the surrounding refractory member 76, as well as the compressible sleeves 102, are selected in order that the tubular refractory members 76 are held in a tight relationship with the rod 84 in order to inhibit fracture of the tubular refractory members 76 as they pass through the bed 14.

To accommodate the differential linear expansion of the rod with regard to the stanchions 86 to prevent any unnecessary stress thereon, the stanchions 86 include a hole 106 for supporting the rod 84 which enables the rod to expand longitudinally within the hole in order to eliminate such stresses.

Because of the inclination of the kiln and the movement of the bed, the rod 84 may be prevented from moving out of the hole 106 by a stop 108, 110, secured thereto by any conventional means for preventing movement of the rod 84 through the hole in 106.

Figure 5:
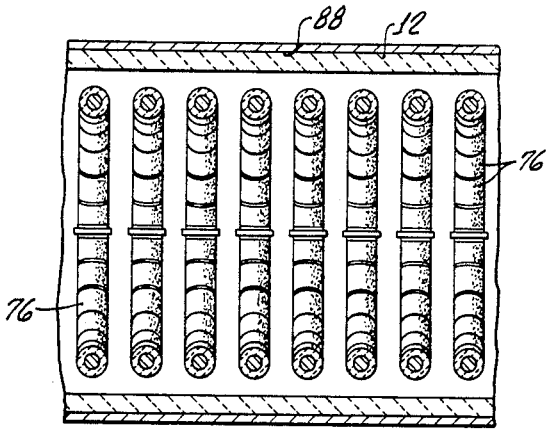
Figure 6:
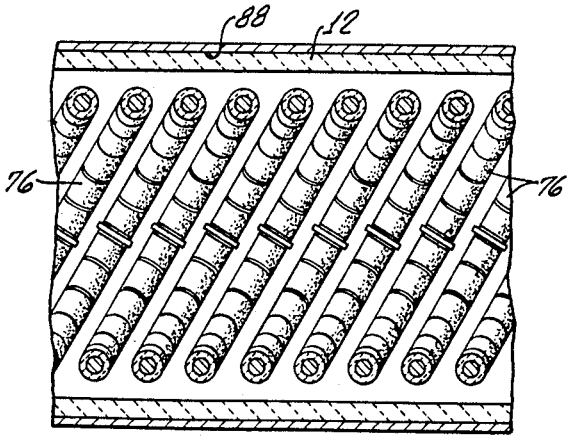

Although it is preferred that the refractory members 76 are assembled and configured in accordance with the FIGS. 1, 2, 3 and 4 of the present patent application, it should be appreciated that different orientation of the refractory members may be useful. Accordingly, as shown in FIGS. 5 and 6, the refractory members are shown in diagrammatic form, to be aligned in a radial pattern about the inner surface of the kiln, and in FIG. 6 in a relationship which is at an angle to the longitudinal access of the rotary kiln.

These alternative arrangements may be chosen depending upon the circumstances of the kiln and the bed used therein. In fact, the use of an angular relationship between the refractory means and the longitudinal access of the kiln as shown in FIG. 6, may be effective in adjusting the velocity at which the bed 14 passes through the kiln 10.

The effectiveness and economy of the present invention, due to reduced fuel requirements, may be illustrated as follows:

A typical long, dry process rotary cement kiln may have a capacity of 1000 tons per day of product at a fuel consumption of 4.7 million BTU's per ton of product. The cost of above fossil fuels may average $2.00 per million BTU's. The heat exchange in accordance with the present invention can reduce the fuel consumption in this dry process kiln by 400,000 BTU's per ton of product. Thus, with an annular operating factor of 85%, the annular fuel savings would be:

1000 tons per day × 0.85 × 365 days × $0.80 = $248,200.

A typical long, wet process rotary cement kiln may have a capacity of 1000 tons per day of product at a fuel consumption of 5.5 million BTU's per ton of product. The heat exchanger in accordance with the present invention can reduce the fuel consumption in this wet process kiln by 300,000 BTU's per ton of product. Thus, the annular fuel saving would be:

1000 tons per day × 0.85 × 365 days × $0.60 = $186,150.

Since the cost of the present heat exchanger is less than $250,000, obvious economic advantages may be had from its utilization.

In addition, the present invention permits higher bed depths, hence higher output from kilns having the same size.

Although there has been hereinabove described a specific heat exchange apparatus and process in accordance with the present invention for the purpose of illustrating the manner in which the invention may be used to advantage, it should be appreciated that the invention is not limited thereto. Accordingly, any and all modifications, variations, or equivalent arrangements, which may occur to those skilled in the art, should be considered to be within the scope of the invention as defined in the appended claims.

What is claimed is:

1. Heat exchange apparatus for use in a rotary kiln, said heat exchange apparatus comprising:

refractory means for transferring heat from an upper heated portion of a rotary kiln above a bed disposed in a lower portion thereof, to within the bed as the rotary kiln is rotated, said refractory means comprising a plurality of tubular refractory members;

means for attaching the refractory means in a spaced apart relationship with an interior wall of the rotary kiln in order to cause the refractory means to pass through the bed with a portion of the bed passing under the refractory means and a portion of the bed passing over the refractory means in order to enhance heat transfer therebetween as the rotary kiln is rotated, said means for attaching the refractory means comprising a plurality of rods supported by a plurality of stanchions, said tubular refractory member being disposed on said rods;

said means for attaching the refractory means and said refractory means being configured and operative for stirring the bed as the refractory means pass through the bed without significant lifting of the bed to the heated upper portions of the rotary kiln as the rotary kiln is rotated; and compressible refractory spacer means disposed between each tubular refractory member for accommodating heat expansion thereof and compressible refractory sleeve means disposed between said rods and said tubular refractory members for accommodating heat expansion of the rods, said rods, compressible refractory sleeve means and tubular refractory members being sized so that the tubular refractory members are tightly held against the tubular refractory spacer means when the rotary kiln is at operating temperatures, in order to inhibit fracture of the tubular refractory member as they pass through the bed.

2. The heat exchange apparatus in accordance with claim 1 wherein each of said stanchions include means defining a hole therein for supporting a rod and enabling the rod to expand longitudinally within the hole in order to eliminate stress therebetween due to thermal expansion.

3. The heat exchange apparatus in accordance with claim 2 wherein each of said stanchions include means defining a hole therein for supporting a rod and enabling the rod to expand longitudinally within the hole in order to eliminate stress therebetween due to thermal expansion.

4. Heat exchanger apparatus for use in a rotary kiln having a reaction bed therein, said heat exchange apparatus comprising:

heat exchange means for introducing thermal energy directly into central portions of a bed disposed in a lower portion of a rotary kiln, said heat exchange means including a refractory means for transferring heat from an upper heated portion of the rotary kiln above the bed into the bed as the rotary kiln is rotated;

means for causing the heat exchange means to cyclically pass the heat exchange means from the upper portion of the rotary kiln to within the bed as the rotary kiln is rotated, said last mentioned means comprising means for attaching the refractory means in a spaced apart relationship with an inner wall of the rotary kiln, said means for attaching the refractory means comprising a plurality of rods supported in a spaced apart relationship with the rotary kiln by a plurality of stanchions and said refractory means comprises a plurality of tubular refractory members disposed on said rods; and compressible refractory spacer means disposed between each tubular refractory member for accommodating heat expansion thereof and tubular refractory spacer means disposed between said rods and said tubular refractory members for accommodating heat expansion of the rods, said rods, tubular refractory spacer means and tubular refractory members being sized so that the tubular refractory members are tightly held against the tubular refractory spacer means when the rotary kiln is at operating temperatures, in order to inhibit fracture of the tubular refractory member as they pass through the bed.

5. A process for transferring heat from heated upper portions of a rotary kiln to within a bed disposed in lower portions of the rotary kiln comprising the steps of:

fixing a plurality of tubular refractory members in a spaced apart relationship with an interior wall of a rotary kiln and parallel to the axis of the rotary kiln, said refractory members being configured and operative for stirring a bed disposed in lower portions of the rotary kiln when the kiln is rotated without significant lifting of the bed to heated upper portions of the rotary kiln, said plurality of tubular refractory members being fixed to the rotary kiln inner wall by a plurality of spaced apart rods supported by a plurality of stanchions attached to the rotary kiln inner wall with compressible refractory spacers between each tubular refractory member and a compressible refractory sleeve disposed between each tubular refractory member and a rod;

disposing a bed within lower portions of the rotary kiln;

heating the upper portions of the rotary kiln; and, rotating the rotary kiln.

* * * * *